US012037760B2

(12) United States Patent
Chin et al.

(10) Patent No.: US 12,037,760 B2
(45) Date of Patent: Jul. 16, 2024

(54) PILE SET MEASUREMENT APPARATUS

(71) Applicants: Jia Yi Chin, Singapore (SG); Hui Jun Chin, Singapore (SG)

(72) Inventors: Jia Yi Chin, Singapore (SG); Hui Jun Chin, Singapore (SG)

( * ) Notice: Subject to any disclaimer, the term of this patent is extended or adjusted under 35 U.S.C. 154(b) by 348 days.

(21) Appl. No.: 17/429,484

(22) PCT Filed: Feb. 12, 2019

(86) PCT No.: PCT/SG2019/050079
§ 371 (c)(1),
(2) Date: Aug. 9, 2021

(87) PCT Pub. No.: WO2020/167243
PCT Pub. Date: Aug. 20, 2020

(65) Prior Publication Data
US 2022/0106760 A1 Apr. 7, 2022

(51) Int. Cl.
*E02D 13/06* (2006.01)
*E02D 33/00* (2006.01)

(52) U.S. Cl.
CPC ..... *E02D 13/06* (2013.01); *E02D 33/00* (2013.01)

(58) Field of Classification Search
CPC ..... E02D 13/06; E02D 13/04; E02D 33/00; E02D 5/22
(Continued)

(56) References Cited

U.S. PATENT DOCUMENTS 3,498,388 A * 3/1970 Jovis ..... E02D 13/06 700/89
4,158,919 A * 6/1979 McMurtry ..... G01B 7/012 33/505
(Continued)

FOREIGN PATENT DOCUMENTS

JP H11293674 10/1999
WO 2017065686 4/2017

OTHER PUBLICATIONS

International Search Report Dated Apr. 18, 2019.
(Continued)

*Primary Examiner* — Dariush Seif
(74) *Attorney, Agent, or Firm* — Preston Smirman; SMIRMAN IP LAW, PLLC

(57) ABSTRACT

The present invention discloses an apparatus (100) for tracing pile set during pile driving of a pile (150) comprising: a panel (110) for attaching to the pile (150); a rotatable holding mechanism (120) with remotely controllable function for holding a writing instrument (160) against the panel (110) to trace the pile set for at least a series of blows during the pile driving; a sliding mechanism (130) with remotely controllable function, which slides on a pair of bearing strips (131', 131") to provide lateral movement of the holding mechanism (120) across the panel (110) after each blow of the pile driving; and a platform (140) with groves for holding the bearing strips (131', 131") in place for allowing the sliding mechanism (130) to slide freely in multiple directions; characterized in that, the holding mechanism has a rotatable lever arm (126) which is secured by a resilient means (129') to reduce excess vibration so that the writing instrument (160) is held in a still position while allowing the lever arm (126) to be rotated by motor controlled arm (127) during the tracing of pile set.

6 Claims, 8 Drawing Sheets

(58) Field of Classification Search
USPC ..... 173/13; 73/11.03
See application file for complete search history.

(56) References Cited

U.S. PATENT DOCUMENTS

| | | | | |
|---|---|---|---|---|
| 4,187,614 | A * | 2/1980 | Abiru | G01B 5/012 33/23.11 |
| 4,660,655 | A * | 4/1987 | Wilner | E02D 7/08 173/87 |
| 5,189,806 | A * | 3/1993 | McMurtry | G01B 21/04 33/553 |
| 5,303,162 | A * | 4/1994 | Yoon | E02D 13/06 702/33 |
| 6,301,551 | B1 * | 10/2001 | Piscalko | E02D 13/06 702/188 |
| 6,441,910 | B1 * | 8/2002 | Christoph | G01B 21/047 356/614 |
| 6,533,502 | B2 * | 3/2003 | McVay | E02D 13/06 405/232 |
| 7,156,188 | B2 * | 1/2007 | Bermingham | E02D 7/02 173/128 |
| 8,522,891 | B2 * | 9/2013 | Heichel | E02D 7/18 173/162.1 |
| 8,763,719 | B2 * | 7/2014 | White | E02D 7/125 173/132 |
| 10,451,519 | B2 * | 10/2019 | Likins, Jr. | E02D 13/06 |
| 10,962,347 | B2 * | 3/2021 | Rudkowski | G01B 21/047 |
| 11,015,315 | B2 * | 5/2021 | Chin | E02D 13/04 |
| 2006/0213279 | A1 * | 9/2006 | Choi | E02D 33/00 73/788 |
| 2007/0074881 | A1 * | 4/2007 | Bermingham | E02D 7/02 173/2 |
| 2008/0189969 | A1 * | 8/2008 | Fuchs | G01B 21/045 33/503 |
| 2014/0023442 | A1 * | 1/2014 | Jung | E02D 13/06 405/232 |
| 2018/0238013 | A1 * | 8/2018 | Gu | G01N 3/30 |
| 2022/0106760 | A1 * | 4/2022 | Chin | E02D 33/00 |

OTHER PUBLICATIONS

Written Opinion of the International Searching Authority Dated Apr. 18, 2019.
International Preliminary Report on Patentability Dated May 12, 2021.
English Abstract of JPH11293674.

* cited by examiner

PILE SET MEASUREMENT APPARATUS

CROSS-REFERENCE TO RELATED APPLICATION

The instant application is a national phase of PCT International Application No. PCT/SG2019/050079 filed Feb. 12, 2019, the entire specification of which is expressly incorporated herein by reference.

FIELD OF INVENTION

The invention relates to a measurement apparatus. More particularly, the invention relates to an apparatus for tracing pile set during pile driving accurately within a safety distance from the pile.

BACKGROUND OF THE INVENTION

Various types of structures such as multi-storey buildings, bridges, parking garages as well as skyscrapers require the support of deep foundation. Such deep foundation normally consists of driven piles which are the main costs of the construction. Therefore, in order to fulfil the optimal economical design as well as quality control and assurance, engineers are required to routinely examine the capacity of deep foundation during and after the pile installing using either or both static and dynamic methods.

In normal construction procedures, a driven pile needs to fulfil an approved pile driving formula. This formula requires measurement of pile sets, temporary compression of pile and soil for the last 10 blows at the end of pile driving. Conventionally, a manual final set graph is drawn by a worker with a pencil in close proximity of the subject pile to trace the pile movement on a piece of paper under a driving hammer. However, such measurement method often exposes the worker towards any potential hazards in occupational safety and health, not to mention that the accuracy may also be affected by ground vibrations and human limitations.

With the development of technology, various remote measuring method had been developed. Such measuring method generally consists of a data acquisition and processing software to collect pile set data. A rangefinder is affixed to a stationary base and an automated equipment is set up prior to the starting of the hammer. However, such method often incurs in high cost and also requires well-trained personnel for the setup.

Accordingly, it would be desirable to develop a measuring apparatus which can overcomes the drawbacks. This invention provides such an apparatus.

SUMMARY OF INVENTION

The main objective of the invention is to provide users with an apparatus for tracing pile set during pile driving of a pile comprising a panel for attaching to the pile, a rotatable holding mechanism with remotely controllable function for holding a writing instrument against the panel to trace the pile set for at least a series of blows during the pile driving, a sliding mechanism with remotely controllable function, which slides on a pair of bearing strips to provide lateral movement of the holding mechanism across the panel after each blow of the pile driving, and a platform with groves for holding the bearing strips in place for allowing the sliding mechanism to slide freely in multiple directions.

Preferably, the holding mechanism has a rotatable lever arm which is secured by a resilient means to reduce excess vibration so that the writing instrument is held in a still position while allowing the lever arm to be rotated by motor-controlled arm during the tracing of pile set.

Preferably, the rotatable lever arm is linked to the motor-controlled arm by a rod (128) with a spring for actuating the rotation of the holding mechanism.

Preferably, the resilient means further provides spring load to the holding mechanism during the tracing of pile set.

Preferably, the apparatus is mounted on a base structure with at least three supporting means extending from the ground.

Preferably, the resilient means is attached to a cylindrical block by means.

Preferably, the apparatus further includes an optical sensor attached to the platform for positioning and locking the sliding mechanism.

Preferably, the apparatus further includes a controller for controlling the movement of the sliding mechanism and the holding mechanism.

Preferably, the controller further includes a display panel being detachably attached to a casing in a way such that the viewing angle of the display panel can be adjusted. One skilled in the art will readily appreciate that the invention is well adapted to carry out the objects and obtain the ends and advantages mentioned, as well as those inherent therein. The embodiments described herein are not intended as limitations on the scope of the invention.

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

The invention will now be described in greater detail, by way of example, with reference to the drawings.

Figure 1:
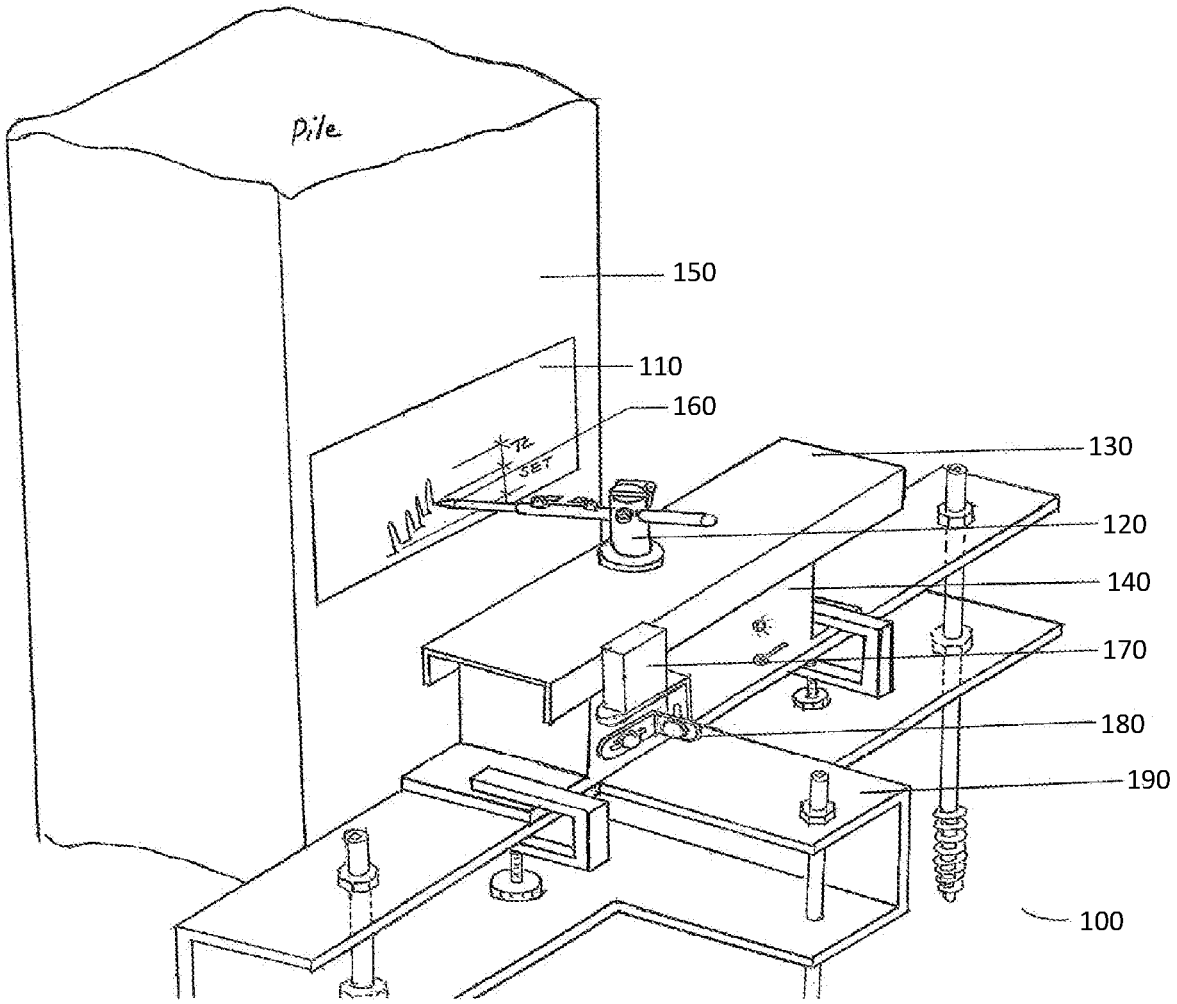
FIG. 1 is a diagram illustrating the apparatus for pile set measurement.

FIG. 1 illustrates an apparatus 100 for tracing pile set during pile driving of a pile 150. The apparatus 100 comprises a panel 110 for attaching to the pile 150, rotatable holding mechanism 120 with remotely controllable function for holding a writing instrument 160 against the panel 110, a sliding mechanism 130 with remotely controllable function, which slides on a pair of bearing strips 131' and 131" to provide lateral movement of the holding mechanism 120 across the panel 110, and a platform with groves for holding the bearing strips 131' and 131" in place. The apparatus is characterized by the holding mechanism 120 having a rotatable lever arm 126 which is secured by a resilient means 129' for ensuring the writing instrument 160 is held in a still position while allowing the lever arm 126 to be rotated by a motor controlled arm 127 during the tracing of pile set.

Preferably, the apparatus 100 further includes an optical sensor 170 attached to a side wall of the platform 140 by a positioning and locking means 180. Preferably, the apparatus 100 is mounted on a base structure 190 with at least three supporting means extending from the ground. In preferred embodiment, the base structure may be a generally T-shape beam structure having at least three adjustable screws for supporting and securing the apparatus 100 in horizontal position. The adjustable screws of the base structure 190 allows the adjustment of apparatus height in conjunction with the pile 150 for accurate pile set tracing.

Preferably, the panel 110 is a sheet of graph paper being detachable attached to a vertical surface of the pile by adhesive means for showing the trace sets per blow during the pile driving. Preferably, the axes of the graph represents information related to the pile set measurement such as number of blow, pile set, temporary compression of the pile 150 and the like.

Preferably, the sliding mechanism 130 is in the form of i a generally U-shaped cover plate 132 for providing lateral movement of the holding mechanism 120 to move across the panel 110 when tracing pile set for each blow. The cover plate 132 is secured to the platform 140 by a pair of bearing strips 131' and 131", which allows the cover plate to slide freely on the bearing strips 131' and 131" for both to and fro directions.

Preferably, the platform 140 has a generally rectangular casing 141 which holds the cover plate 132 by the pair of bearing strips 131' and 131". During the measurement, the platform 140 is further attached to the base structure 190.

Figure 2:
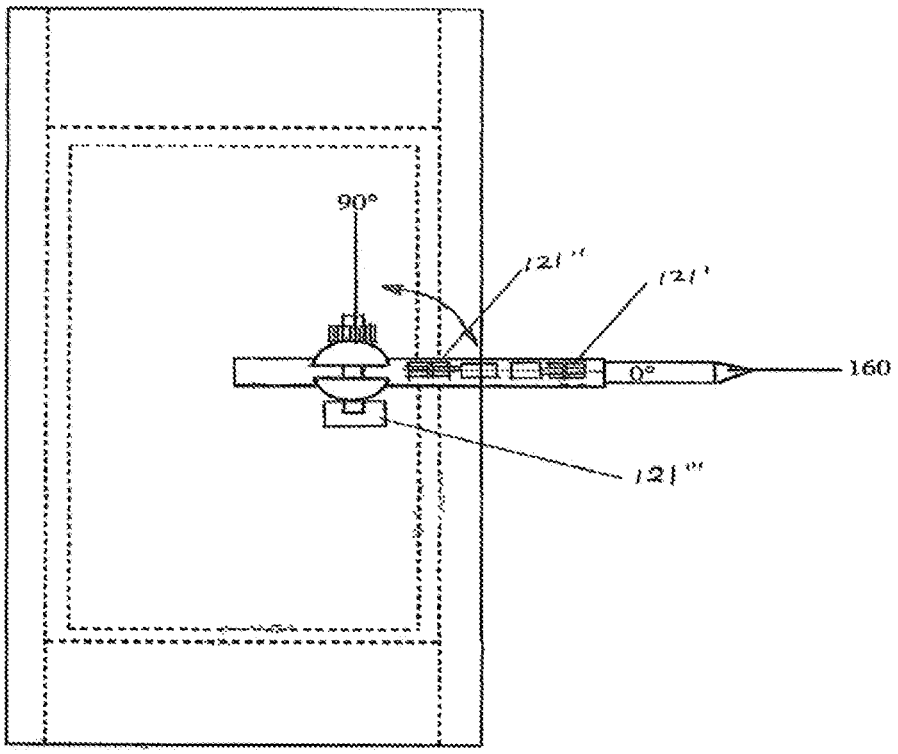
FIG. 2 is a diagram illustrating the top view of the holding mechanism.
Figure 3:
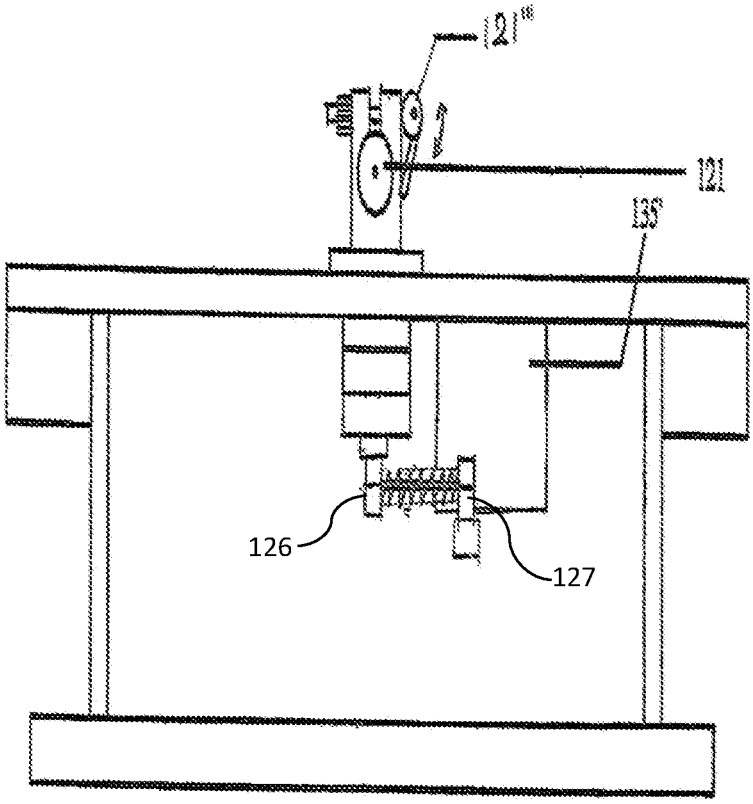
FIG. 3 is a diagram illustrating the elevated sectional view of the holding mechanism.

In one preferred embodiment as shown in FIG. 2 and FIG. 3, the holding mechanism 120 further comprises a holding tube 121 and a top rotating means for holding and controlling the writing instrument 160. The holding tube 121 has a pair of clamps 121' and 121" for securing the writing instrument 160 firmly therewithin. Meanwhile, the holding tube 121 is preferred to be in form of a generally cylindrical block 122 which is secured by clamp 121'''. The cylindrical block 122 is remotely controlled to rotate in a right-angled manner to and fro, either horizontally, transversely or parallel to the panel 110 at a predetermined distance. Alternatively, the cylindrical block 122 may also be automatically rotated in some operation conditions.

Preferably, the holding mechanism 120 is further provided with a rotating means, which allows the holding mechanism 120 to rotate at a horizontal axis within an angle range of substantially 0 to 90 degrees. Preferably, the writing instrument 160 is perpendicular to the panel 110 when the angle of rotation is at 0 degree while the writing instrument 160 is parallel to the panel 110 when the angle of rotation is at 90 degrees.

Preferably, the rotatable lever arm 126 is linked to motor controlled arm 127 by a rod 128 with a spring 129 for actuating the rotation of the holding mechanism 120. The rod 128 is placed within the spring 129 which acts as a stopper for keeping the spring in tension condition. The motor controlled arm 127 is further connected to a micro-motor 135' located beneath the cover plate 132. Upon receiving an actuating signal, the motor controlled arm 127 pulls or pushes spring 129 and rod 128 to provide the rotational movement of the writing instrument 160.

Figure 4:
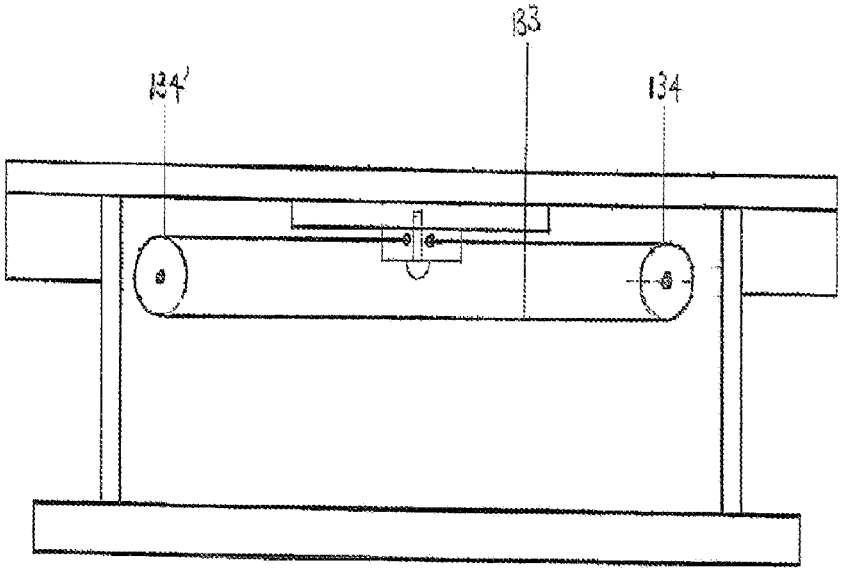
FIG. 4 is a diagram illustrating the belt and pulleys arrangement.
Figure 5:
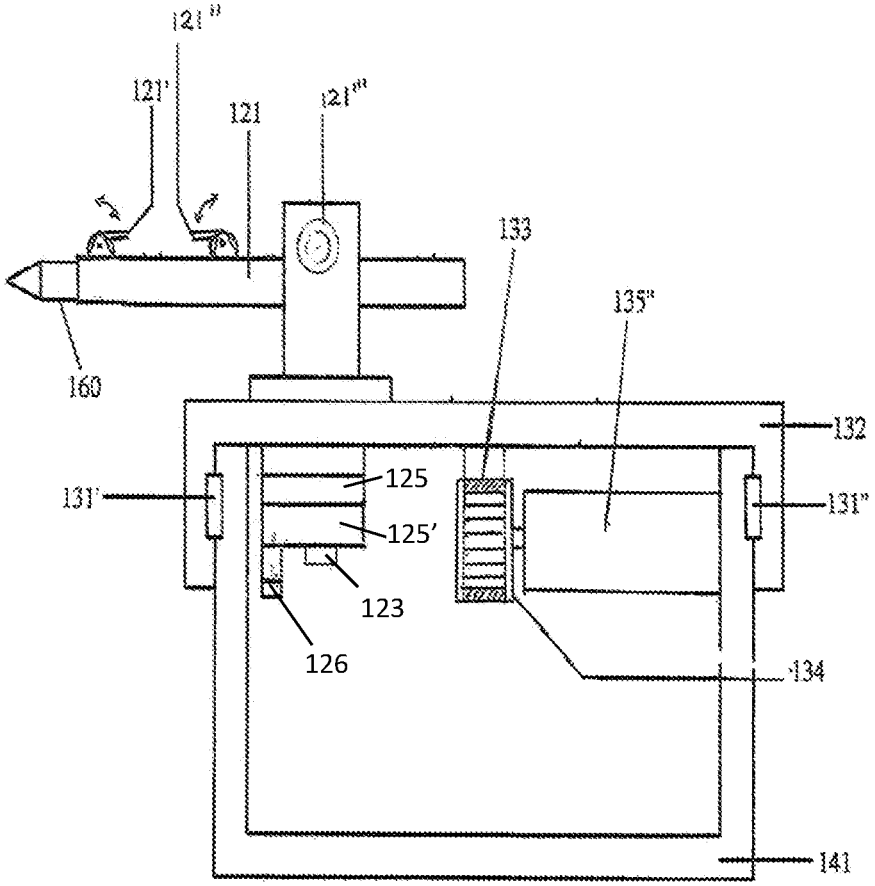
FIG. 5 is a diagram illustrating the working principle of the sliding mechanism.

Consistent with the preferred embodiment as shown in FIG. 4 and FIG. 5, the apparatus may be controlled by a worker within a safe distance from the pile 150 via a remote controller. Preferably, the remote controller includes a transmitter with a control panel, a display panel with a receiver and power supplies. Preferably, the control panel is provided with means for controlling the rotational movement of the writing instrument 160 and the transverse movement of the sliding mechanism 130. Preferably, the rotational movement is actuated by the micro-motor 135' located beneath the cover plate 132 while the transverse movement is actuated by movement of a belt 133 which is controlled by at least a pulley 134 connected to the micro-motor 135".

In an alternative embodiment, in which the movement of the holding mechanism 120 and the sliding mechanism works automatically. A pressure sensor and a vibration sensor may be installed on the apparatus 100 for transmitting information to a central processor. Preferably, the pressure sensor detects the spring pressure applied to the rod, allowing the remote controller to control the rotation of the writing instrument 160 in respond to the spring pressure. Preferably, the vibration sensor is installed beneath the cover plate 132 to communicate with the remote controller to slide the cover plate 132 transversely after the detection of each blow.

Figure 6:
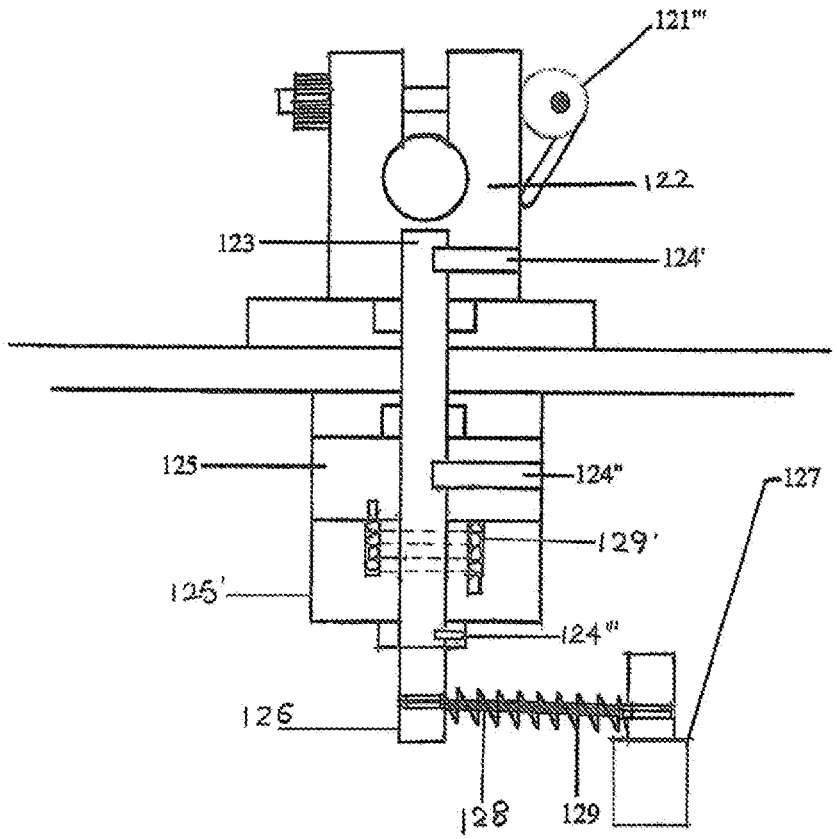
FIG. 6 is a diagram illustrating the holding mechanism with rotatable means.

Referring to FIG. 6, the detail component of the holding mechanism 120 is illustrated. The holding mechanism 120 further comprises a top cylindrical block 122, a bottom cylindrical block 125', a shaft 123 for connecting the top cylindrical block 122 and the bottom cylindrical block 125, a rotatable lever arm 126 connected to the bottom cylindrical block 125', and a rod 128 incorporated with a spring 129 for connecting the rotatable lever arm 126 to a motor controlled arm 127. Preferably, the writing instrument is secured to a holding tube 121 by a pair of clamps 121' and 121". The holding tube 121 is further slidably attached to a hollow portion of the top cylindrical block 122 and is secured by a clamp 121'''. The top cylindrical block 122 is further secured to the shaft 123 by a screw 124' to hold is position within a top and bottom bearings for smooth rotation of the holding mechanism 120. The bottom cylindrical block 125 further secured to a bottom portion of the shaft 123 by screw 124" to ensure minimal vertical movement of the holding tube 121.

Further, the rotatable lever arm 126 is secured to an extended bottom cylindrical block 125' which holds the rotatable lever arm 126 in place during the rotation. Preferably, the top end of the rotatable lever arm 126 is inserted into the extended bottom cylindrical block 125' which prevents the rotatable lever arm 126 from dropping out by having a larger top end diameter which is able to support the rotatable lever arm 126 in place. However, such configuration does not restrict the rotation of the rotatable lever 126 during the push and pull of the rod 128 and spring 129. A resilient means 129' is attached to the extended bottom cylindrical block 125' for securing the rotatable lever arm 126 in a way to reduce excess vibration so that the writing instrument (160) is held in a still position while allowing the lever arm (126) to be rotated by motor-controlled arm (127) during the tracing of pile set. Preferably, the resilient means 129 also provides further spring load to the holding mechanism 120 such that the holding mechanism 120 can be rotated smoothly.

Figure 7:
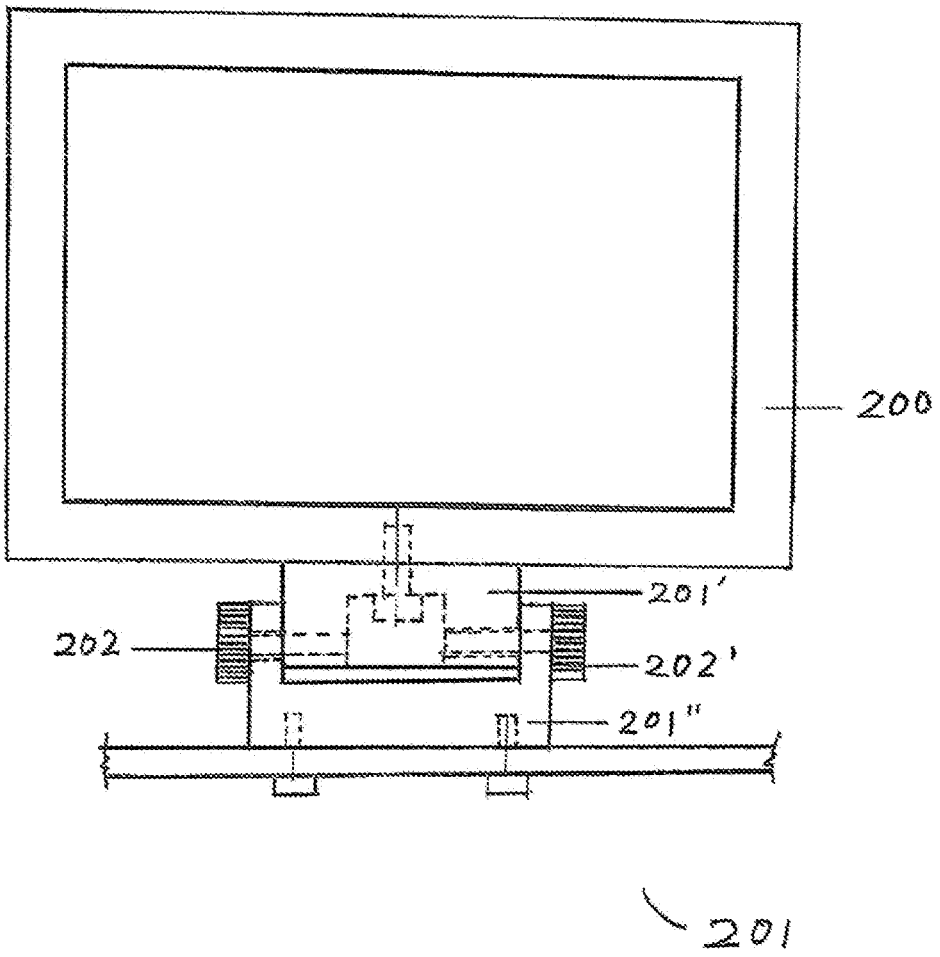
FIG. 7 is a diagram illustrating the means for attaching a display panel onto a controller.

Referring to FIG. 7, an example of controller for controlling the movement of the apparatus is illustrated. Preferably, the controller connects the apparatus wireless, how it should be understood that the controller may also be connected to the apparatus via wired connection. In a preferred embodiment, the controller includes a control panel on its casing 201 and a display panel 200 being detachably attached to the controller 201. Preferably, both the controller 201 and the display panel 200 includes an interdigitating member 201', 201" each for allowing the controller 201 and the display panel 200 to be hinged together. Preferably, a means of a pin 202 is slid through the interdigitating member 201', 201" to allow the adjustment of viewing angle of the display panel 200. Further, a locking means 202' is provided to fasten the interdigitating member 201', 201" such that the display panel 200 can be fixed and secured at any desired position.

Figure 8:
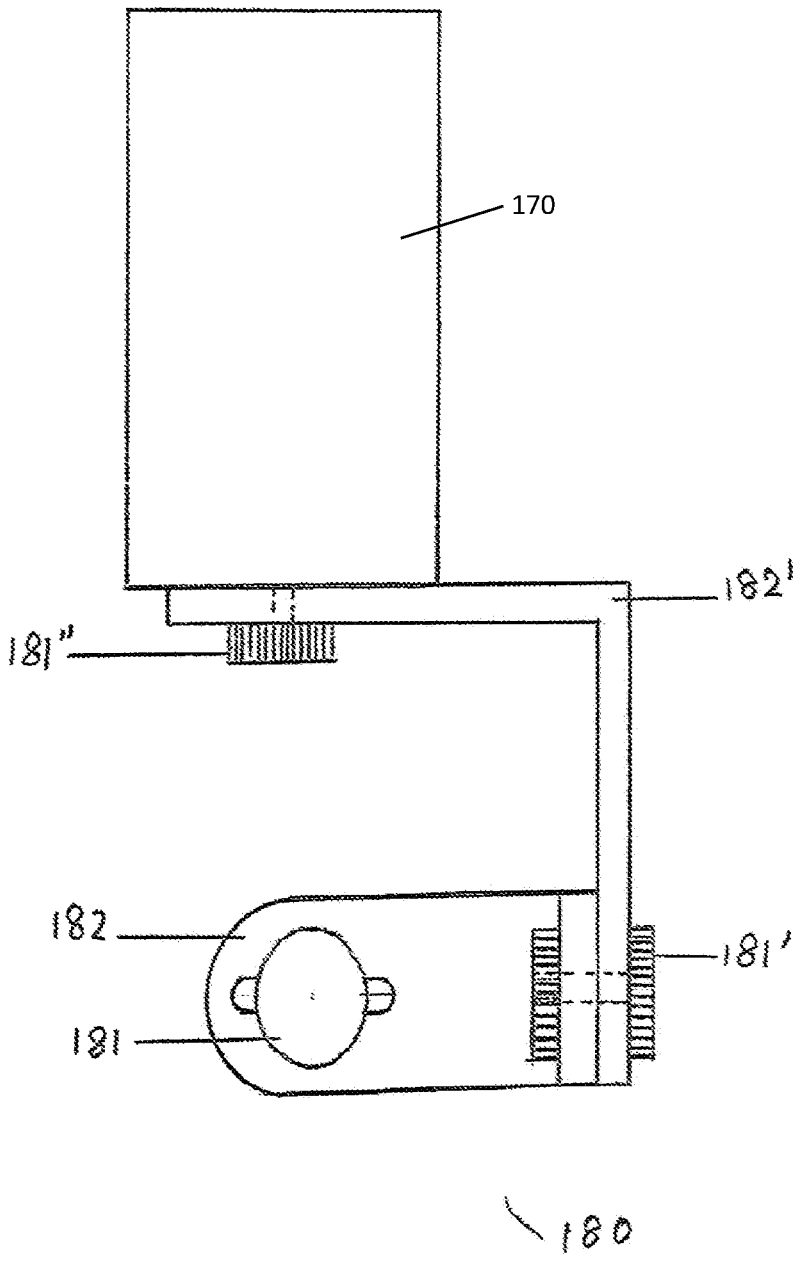
FIG. 8 is a diagram illustrating the bracket for attaching the optical sensor.

Referring to FIG. 8, the movement of the cover plate 132 and the writing instrument 160 can be monitor remotely via an optical sensor 170 in real time. Preferably, the optical sensor 170 is attached to a side wall of the casing 141 by means of a bracket 180. Preferably, the bracket 180 comprises a pair of generally L-shaped structure 182 and 182' for attaching to the casing 141 and the optical sensor 170 at its one end respectively. Both the L-shaped structure 182 and 182' is connected at another free end by an adjustable means 181' in a way such that the view angle of the optical sensor 170 can be adjustable. Further adjustable means 181 and 181" also attached to casing 141 and the optical sensor 170 respectively for providing multi-axial rotation of the optical sensor 170 while securing the position of the optical sensor 170.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

The invention claimed is:

1. An apparatus for tracing pile set during pile driving of a pile, comprising:

a panel for attaching to the pile;

a rotatable holding mechanism with remotely controllable function that holds a writing instrument against the panel to trace the pile set for at least a series of blows during the pile driving, which comprises a rotatable lever arm;

a sliding mechanism with remotely controllable function, which slides on a pair of bearing strips to provide lateral movement of the holding mechanism across the panel after each blow of the pile driving; and a platform with groves for holding the bearing strips in place for allowing the sliding mechanism to slide freely in multiple directions;

wherein the lever arm is actuated to rotate by a motor controlled arm that pushes or pulls both a rod and a spring against the lever arm, with the rod being within the spring for the rod to act as a stopper that keeps the spring in tension condition; and wherein the lever arm is configured to rotate while being in connection with an extended bottom cylindrical block, with the extended bottom cylindrical block connected to a bottom cylindrical block of a shaft, via a resilient means, and with the bottom cylindrical block secured to the shaft, so that excess vibration from pile driving of the pile is reduced to enable the writing instrument to be held in position while allowing the lever arm to be rotated by the motor controlled arm during the tracing of pile set.

2. The apparatus according to claim 1, wherein the holding mechanism further comprises a top cylindrical block where the writing instrument is held, the bottom cylindrical block, the shaft that connects the top cylindrical block and the bottom cylindrical block, and the extended bottom cylindrical block that is connected beneath the bottom cylindrical block, wherein the extended bottom cylindrical block is not rigidly attached to the shaft so that which can be rotated by the rotatable lever arm while the shaft is stationary.

3. The apparatus as claimed in claim 2, wherein the apparatus is mounted on a base structure with at least three supporting means extending from the ground, wherein the three supporting means being adjustable to allow adjustment of apparatus height in conjunction with the pile.

4. The apparatus as claimed in claim 1, further comprising an optical sensor attached to the platform for monitoring the movement of the sliding mechanism and the writing instrument.

5. The apparatus as claimed in claim 1, further comprising an interdigitating member to hinge a display panel on a controller for controlling the movement of the sliding mechanism and the holding mechanism, wherein the interdigitating member allows the viewing angle of the display panel to be adjusted and locked at any viewing angle.

6. The apparatus as claimed in claim 1, wherein the sliding mechanism further includes a belt for actuating transverse movement of the sliding mechanism.

* * * * *